US009830860B2

(12) United States Patent
In et al.

(10) Patent No.: US 9,830,860 B2
(45) Date of Patent: Nov. 28, 2017

(54) ORGANIC LIGHT EMITTING DISPLAY AND METHOD FOR DRIVING THE SAME

(71) Applicant: SAMSUNG DISPLAY CO., LTD., Yongin, Gyeonggi-Do (KR)

(72) Inventors: Hai-Jung In, Yongin (KR); Yong-Sung Park, Yongin (KR); Il-Hun Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/618,973

(22) Filed: Feb. 10, 2015

(65) Prior Publication Data

US 2015/0243219 A1 Aug. 27, 2015

(30) Foreign Application Priority Data

Feb. 25, 2014 (KR) ..... 10-2014-0021788

(51) Int. Cl.

| | |
|---|---|
| ***G09G 3/30*** | (2006.01) |
| ***G09G 3/3258*** | (2016.01) |
| ***G09G 3/3291*** | (2016.01) |
| ***G09G 3/20*** | (2006.01) |
| ***G09G 3/3233*** | (2016.01) |

(52) U.S. Cl.

CPC ..... *G09G 3/3258* (2013.01); *G09G 3/2022* (2013.01); *G09G 3/2081* (2013.01); *G09G 3/3233* (2013.01); *G09G 3/3291* (2013.01); *G09G 2300/0842* (2013.01); *G09G 2300/0876* (2013.01); *G09G 2330/02* (2013.01)

(58) Field of Classification Search

None

See application file for complete search history.

(56) References Cited

U.S. PATENT DOCUMENTS

| | | | | |
|---|---|---|---|---|
| 8,289,237 | B2 | 10/2012 | Choi et al. | |
| 2006/0077138 | A1 | 4/2006 | Kim | |
| 2006/0092107 | A1 | 5/2006 | Kim | |
| 2007/0128583 | A1* | 6/2007 | Miyazawa | G09G 3/3233 434/433 |
| 2008/0238328 | A1* | 10/2008 | Shin | G09G 3/2022 315/169.3 |
| 2014/0292826 | A1* | 10/2014 | In | G09G 3/2022 345/690 |

FOREIGN PATENT DOCUMENTS

| | | | |
|---|---|---|---|
| KR | 2002-0040258 | A | 5/2002 |
| KR | 10-2006-0025285 | A | 3/2006 |
| KR | 10-2006-0032826 | A | 4/2006 |
| KR | 10-0821046 | B1 | 4/2008 |

* cited by examiner

*Primary Examiner* — Ifedayo Iluyomade

(74) *Attorney, Agent, or Firm* — Lewis Roca Rothgerber Christie LLP

(57) ABSTRACT

An organic light emitting display includes: a display panel including pixels at crossing regions of data lines and scan lines; a scan driver configured to divide one frame into a plurality of sub-fields, to divide each of the subfields into p (p is a positive integer of 2 or more) periods, and to supply scan signals to the scan lines; and a data driver configured to supply data voltages to the data lines concurrently with supply of respective scan signals, wherein a gray scale voltage from among (P+1) gray scale voltages is supplied as at least one of the data voltages.

11 Claims, 5 Drawing Sheets

ORGANIC LIGHT EMITTING DISPLAY AND METHOD FOR DRIVING THE SAME

CROSS-REFERENCE TO RELATED APPLICATION

This application claims priority to and the benefit of Korean Patent Application No. 10-2014-0021788, filed on Feb. 25, 2014, in the Korean Intellectual Property Office, the entire content of which is incorporated herein by reference in its entirety.

BACKGROUND

1. Field

An aspect of embodiments of the present invention relates to an organic light emitting display and a method for driving the same.

2. Description of the Related Art

Recently, there have been developed various types of flat panel displays that have reduced weight and volume in comparison to cathode ray tubes. The flat panel displays include liquid crystal displays, field emission displays, plasma display panels, organic light emitting displays, and the like.

Among these flat panel displays, the organic light emitting display displays images using organic light emitting diodes that emit light through recombination of electrons and holes. The organic light emitting display has a fast response speed and is simultaneously driven with low power consumption.

The organic light emitting display includes a data driver configured to supply data voltages to data lines, a scan driver configured to supply scan signals to scan lines, and pixels respectively positioned at areas defined by scan lines and data lines (e.g., at crossings of the scan lines and the data lines). The pixel controls current supplied to an organic light emitting diode, based on a data voltage supplied to a gate electrode of a driving transistor.

The pixel of the organic light emitting display can be driven by an analog driving method or a digital driving method. The analog driving method is a method of adjusting the emission amount of the organic light emitting diode by controlling the drain-source current of the driving transistor, based on the data voltage. The digital driving method is a method of adjusting the emission period of the organic light emitting diode by controlling the turn-on of the driving transistor, based on the data voltage.

Specifically, in the digital driving method, one frame is divided into a plurality of subfields, and the organic light emitting diode emits light by turning on the driving transistor in each subfield or does not emit light by turning off the driving transistor in each subfield. Thus, each pixel may represent two gray scale levels in each subfield. As a result, in the digital driving method, each pixel represents gray scale levels, based on a combination of the emission/non-emission of the organic light emitting diode, in each subfield.

Accordingly, in the digital driving method, the gray scale representation ability of the pixel depends on the number of sub-fields. The gray scale representation ability of the pixel refers to how many gray scale levels the pixel can represent. For example, when each pixel is to represent two gray scale levels in each subfield, the pixel may represent $2^n$ (n is a positive integer) gray scale levels according to the number of subframes. In this case, the one frame may be divided into n subfields. For example, when the pixel represents 64 gray scale levels, the one frame may be divided into six subfields.

When the pixel represents 256 gray scale levels, the one frame may be divided into eight subfields. However, there is a problem in that as the one frame period is divided into a larger number of subfields, the frame frequencies of the scan and data drivers increase.

SUMMARY

Embodiments of the present invention provide an organic light emitting display driven by a digital driving method and a method for driving the same, in which each pixel represents at least three or more gray scale levels in each subfield, thereby reducing the number of subfields of one frame.

According to one embodiment of the present invention, there is provided an organic light emitting display including: a display panel including pixels at crossing regions of data lines and scan lines; a scan driver configured to divide one frame into a plurality of sub-fields, to divide each of the subfields into p (p is a positive integer of 2 or more) periods, and to supply scan signals to the scan lines; and a data driver configured to supply data voltages to the data lines concurrently with supply of respective scan signals, wherein a gray scale voltage from among (P+1) gray scale voltages is supplied as at least one of the data voltages.

In one example embodiment, each of the pixels includes: a driving transistor including a gate electrode and configured to be turned on or turned off according to a voltage of the gate electrode; a first transistor configured to supply a data voltage of a data line of the data lines to the gate electrode of the driving transistor in response to a scan signal of a scan line of the scan lines; and an organic light emitting diode configured to emit light according to a drain-source current of the driving transistor.

In one example embodiment, the pixel further includes a capacitor coupled between the gate electrode of the driving transistor and a reference voltage line to which a reference voltage is supplied.

In one example embodiment, the reference voltage in a q-th (q is a positive integer satisfying $1 \leq q \leq p$) period is a voltage higher or lower by a set voltage than a reference voltage in a (q+1)-th period.

In one example embodiment, an r-th (r is a positive integer satisfying $1 \leq r \leq p$) data voltage is a voltage higher or lower by the set voltage than a (r+1)th data voltage.

In one example embodiment, the pixel further includes a second transistor coupled between the gate electrode of the driving transistor and a power voltage line for supplying a power voltage.

In one example embodiment, the power voltage is a high power voltage and the power voltage line is coupled to a first electrode of the driving transistor.

In one example embodiment, the power voltage is an initialization voltage.

According to another embodiment of the present invention, there is provided a method for driving an organic light emitting display including a display panel including pixels arranged in a matrix at crossing regions of data lines and scan lines, the method including: dividing one frame into a plurality of sub-fields, dividing each of the subfields into p (p is a positive integer of 2 or more) periods, and supplying scan signals to the scan lines; and supplying data voltages to the data lines concurrently with the respective scan signals of the plurality of scan signals, wherein, in the supplying of the data voltages to the data lines, a gray scale voltage form among (p+1) gray scale voltages is supplied as at least one of the data voltages.

BRIEF DESCRIPTION OF THE DRAWINGS

Example embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
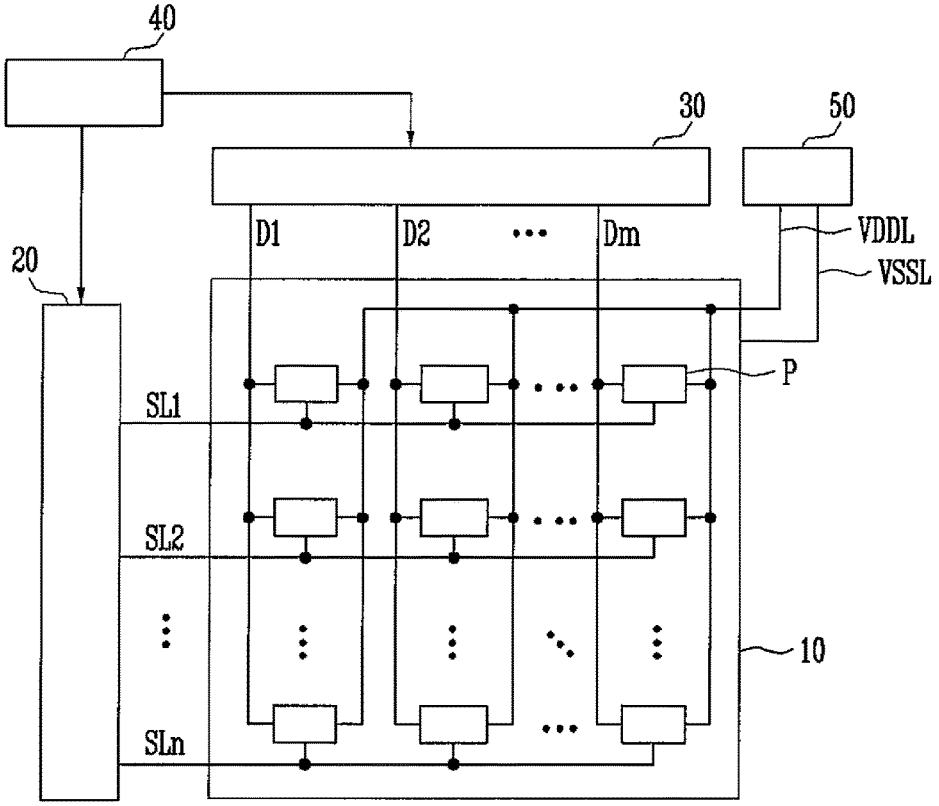
FIG. 1 is a block diagram illustrating an organic light emitting display according to an embodiment of the present invention.

Hereinafter, certain example embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention may be omitted for clarity. Also, like reference numerals refer to like elements throughout.

FIG. 1 is a block diagram illustrating an organic light emitting display according to an embodiment of the present invention.

Referring to FIG. 1, the organic light emitting display according to this embodiment includes a display panel 10, a scan driver 20, a data driver 30, a timing controller 40, a power supply source 50, and the like.

Data lines D1 to Dm (m is a positive integer of 2 or more) and scan lines SL1 to SLn (n is a positive integer of 2 or more) are formed to cross each other at the display panel 10. Pixels P arranged in a matrix form at crossings regions of the data lines D1 to Dm and the scan lines SL1 to SLn are formed in the display panel 10. The pixel P of the display panel 10 according to this embodiment will be described in detail later with reference to FIGS. 3, 6, 9 and 12.

The scan driver 20 supplies scan signals to the scan lines SL1 to SLn, in response to a scan timing control signal SCS. The scan driver 20 divides one frame into a plurality of subfields for driving the organic light emitting display.

Figure 2:
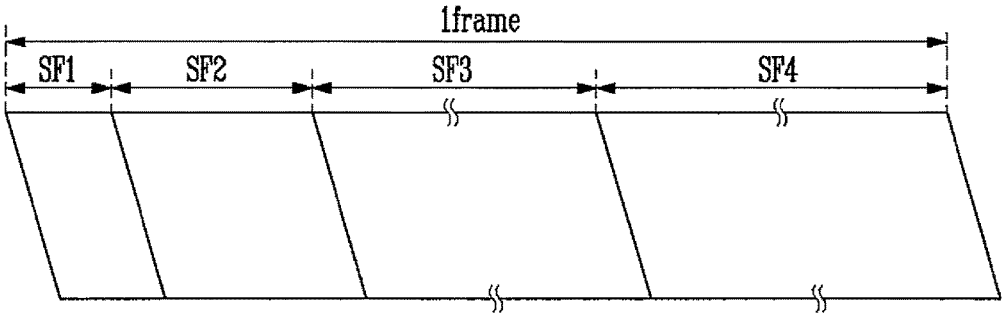
FIG. 2 is an example diagram illustrating subfields of one frame in a digital driving method.

The scan driver 20 may sequentially supply the scan signals to the scan lines SL1 to SLn. In this case, the scan driver 20 may be implemented as a decoder type scan driver. Alternatively, the scan driver 20, as shown in FIG. 2, may sequentially supply the scan signals to the scan lines SL1 to SLn in each of the plurality of subfields. In this case, the scan driver 20 may be implemented as a shift register type scan driver. The shift register type scan driver 20 may include a shift register configured to sequentially output signals, a level shifter configured to shift the signals output from the shift register to have a swing width suitable for driving transistors of the pixel P, an output buffer, and the like.

The data driver 30 includes at least one source drive IC. The source drive IC receives a digital video data DATA input from the timing controller 40. The source drive IC converts the digital video data DATA into data voltages, in response to a source timing control signal from the timing controller 40. The source drive IC supplies the data voltages to the data lines D1 to Dm, in synchronization with each scan signal. Accordingly, the data voltages are supplied to pixels P to which the scan signal is supplied.

The timing controller 40 receives the digital video data DATA input from a host system through an interface such as a low voltage differential signaling (LVDS) interface or a transition minimized differential signaling (TMDS) interface. The timing controller 40 receives timing signals including a vertical sync signal, a horizontal sync signal, a data enable signal, a dot clock, and the like. The timing controller 40 generates timing control signals for controlling operation timings of the data driver 30 and the scan driver 20, based on the timing signals. The timing control signals include a scan timing control signal SCS for controlling an operation timing of the scan driver 20, and a data timing control signal DCS for controlling an operation timing of the data driver 30. The timing controller 40 outputs the scan timing control signal SCS to the scan driver 20, and outputs the data timing control signal DCS and the digital video data DATA to the data driver 30.

The power supply source 50 supplies a first power voltage to each pixel P of the display panel 10 through a first power voltage line, and supplies a second power voltage to each pixel P of the display panel 10 through a second power voltage line. The first power voltage may be a high power voltage ELVDD, and the second power voltage may be a low power voltage ELVSS. Hereinafter, for convenience of illustration, the case where the first power voltage line is a high power voltage line VDDL and the second power voltage line is a low power voltage line VSSL will be primarily described.

The power supply source 50 supplies a reference voltage to each pixel P of the display panel 10 through a reference voltage line. Further, the power supply source 50 may supply an initialization voltage to each pixel P of the display panel 10 through an initialization voltage line. The reference voltage line and the initialization voltage line will be described in detail later with reference to FIGS. 3, 6, 9 and 12. The reference voltage will be described in detail later with reference to FIGS. 3, 5, 6, 8, 9, 11, 12 and 14.

FIG. 2 is an example diagram illustrating subfields of one frame in a digital driving method. The organic light emitting display according to this embodiment is driven by the digital driving method. In the digital driving method, the one frame is divided into a plurality of subfields for driving the organic light emitting display.

Referring to FIG. 2, the one frame is divided into a plurality of subfields. Although it has been illustrated in FIG. 2 that the one frame is divided into four subfields SF1, SF2, SF3 and SF4, the present invention is not limited thereto.

The periods of first to fourth subfields SF1, SF2, SF3 and SF4 are different from one another. The period of the subfield may increase from the first subfield SF1 to the fourth subfield SF4. For example, as shown in FIG. 2, the period of an i-th (i is a positive integer) subfield may be set as a $2^{i-1}\times t$ period. That is, the first, second, third and fourth subfields SF1, SF2, SF3 and SF4 may be set as t, 2t, 4t and 8t periods, respectively. In this case, each pixel P represents a gray scale level according to whether each pixel P may light during the respective subfields.

As described above, in this embodiment, the one frame is divided into a plurality of subfields, and each pixel P represents a gray scale level or gray level (e.g., a predetermined gray scale level) in each subfield. As a result, in this embodiment, the gray scale level of each pixel P can be represented according to a combination of gray scale levels that each pixel P represents in the subfields.

Figure 3:
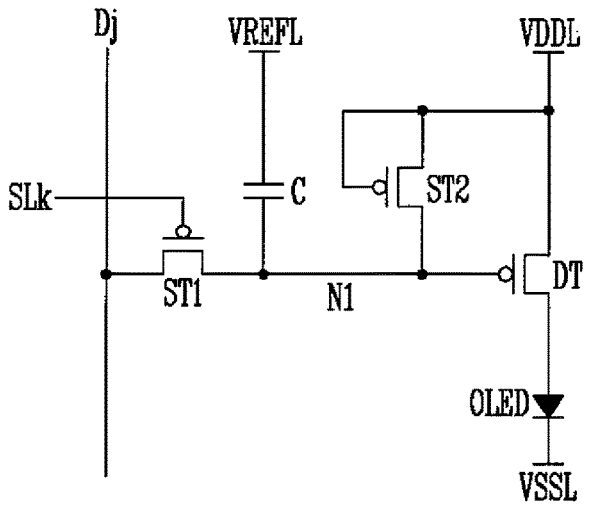
FIG. 3 is an equivalent circuit diagram of a pixel according to a first embodiment of the present invention.

FIG. 3 is an equivalent circuit diagram of a pixel according to a first embodiment of the present invention.

Referring to FIG. 3, the pixel P is coupled to a k-th (k is a positive integer satisfying $1\leq k\leq n$) scan line and a j-th (j is a positive integer satisfying $1\leq j\leq m$) data line. In addition, the pixel P is coupled to the high power power voltage line VDDL, the low power power voltage line VSSL and a reference voltage line VREFL.

The pixel P may include a driving transistor DT, an organic light emitting diode OLED, a plurality of transistors, a capacitor C, and the like. The plurality of transistors may include first and second transistors ST1 and ST2.

The driving transistor DT is turned on or turned off based on a data voltage supplied to a gate electrode thereof. The gate electrode of the driving transistor DT is coupled to a first node N1, and a first electrode of the driving transistor DT is coupled to the high power voltage line VDDL. A second electrode of the driving transistor DT is coupled to an anode electrode of the organic light emitting diode OLED. Here, the first electrode may be a source or drain electrode, and the second electrode may be an electrode different from the first electrode. For example, if the first electrode is the source electrode, the second electrode may be the drain electrode.

When the driving transistor DT is turned on, the organic light emitting diode OLED receives a current (e.g., a predetermined current) to emit light. The anode electrode of the organic light emitting diode OLED is coupled to the second electrode of the driving transistor DT, and a cathode electrode of the organic light emitting diode OLED is coupled to the low power voltage line VSSL.

The first transistor ST1 is coupled between the first node N1 and the j-th data line Dj. The first transistor ST1 is turned on by a scan signal of the k-th scan line SLk, to supply a data voltage of the j-th data line Dj to the first node N1. A gate electrode of the first transistor ST1 is coupled to the k-th scan line SLk, and a first electrode of the first transistor ST1 is coupled to the j-th data line Dj. A second electrode of the first transistor ST1 is coupled to the first node N1.

The second transistor ST2 is coupled between the first node N1 and the high power voltage line VDDL. A gate electrode and a first electrode of the second transistor ST2 are coupled to the high power voltage line VDDL, and a second electrode of the second transistor ST2 is coupled to the first node N1. That is, the second transistor ST2 is diode-coupled.

The second transistor ST2 is formed of a P-type metal oxide semiconductor field effect transistor (MOSFET), and thus is turned on when its gate-source voltage Vgs is lower than its threshold voltage Vth2 (Vgs<Vth2). That is, the second transistor ST2 is turned on when the difference in voltage between the high power voltage ELVDD that is a gate voltage and the voltage of the first node N1, which is a source voltage, is lower than the threshold voltage Vth2. As the second transistor ST2 is turned on, the first node N1 is coupled to the high power voltage line VDDL. In this case, the voltage of the first node N1 is discharged to the difference voltage (ELVDD−Vth2) between the high power voltage ELVDD and the threshold voltage Vth2 of the second transistor ST2. As a result, the second transistor ST2 performs a function of maintaining the voltage of the first node N1 not to be greater than the difference voltage (ELVDD−Vth2) between the high power voltage ELVDD and the threshold voltage Vth2 of the second transistor ST2.

The capacitor C is coupled between the first node N1 and the reference voltage line VREFL. That is, one electrode of the capacitor C is coupled to the first node N1, and the other electrode of the capacitor C is coupled to the reference voltage line VREFL.

A semiconductor layer of each of the driving transistor DT and the first and second transistors ST1 and ST2 may be formed of poly silicon, but the present invention is not limited thereto. That is, the semiconductor layer of each of the driving transistor DT and the first and second transistors ST1 and ST2 may be formed of any one of a-Si and oxide semiconductor, particularly oxide. When the semiconductor layer of each of the driving transistor DT and the first and second transistors ST1 and ST2 is formed of the poly silicon, the process of forming the semiconductor layer may be a low temperature poly silicon (LTPS) process. In FIG. 3, the case where the driving transistor DT and the first and second transistors ST1 and ST2 are formed of P-type has been primarily described.

Figure 4:
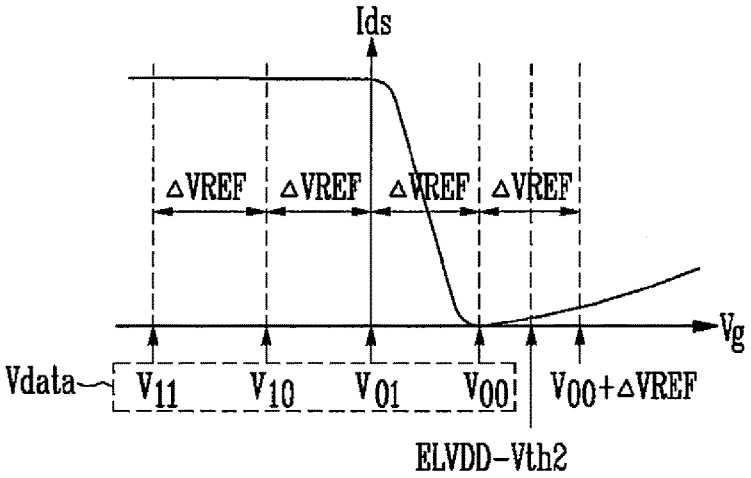
FIG. 4 is an example diagram illustrating drain-source current with respect to a gate voltage of a driving transistor in the pixel according to the first embodiment of the present invention.

FIG. 4 is an example diagram illustrating drain-source current with respect to a gate voltage of the driving transistor in the pixel according to the first embodiment of the present invention. In FIG. 4, the x-axis corresponds to gate voltages Vg of the driving transistor DT, and the y-axis corresponds to drain-source currents Ids. In the graph of FIG. 4, the case where the driving transistor DT is formed of a P-type as shown in FIG. 3 has been primarily illustrated.

Figure 5:
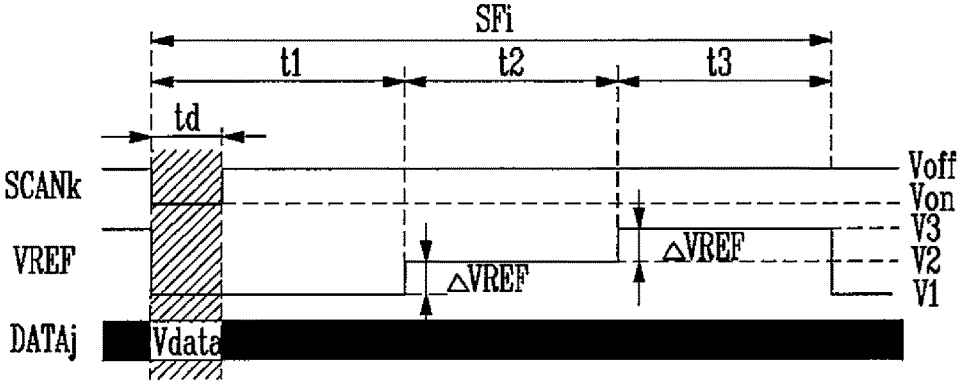
FIG. 5 is a waveform diagram illustrating an example of a scan signal, a reference voltage and a data voltage, supplied to the pixel of FIG. 3.

One frame period is divided into a plurality of subfields, and each subfield is divided into p (p is a positive integer of 2 or more) periods as shown in FIG. 5. In this case, the data voltage may be supplied as any one gray scale voltage among p+1 gray scale voltages. For convenience of illustration, the case where the one frame is divided into three subfields, and the data voltage is supplied as any one gray scale voltage among four gray scale voltages, i.e., first to fourth gray scale voltages V00, V01, V10 and V11 has been primarily described in FIG. 4. P periods of each subfield will be described in detail later with reference to FIG. 5.

Referring to FIG. 4, the driving transistor DT is formed of a P-type. Thus, the driving transistor DT may be turned on when its gate-source voltage Vgs is lower than its threshold voltage, and be turned off when its gate-source voltage Vgs is higher than or equal to its threshold voltage.

The first gray scale voltage V00 corresponds to a turn-off voltage at which the driving transistor DT is turned off. That is, the voltage difference (ELVDD−V00) between the high power voltage ELVDD and the first gray scale voltage V00 is higher than or equal to the threshold voltage of the driving transistor DT. The turn-off voltage means a voltage allowing the drain-source current Ids of the driving transistor DT, lower than a reference current (e.g., a predetermined current), to flow. The reference current (e.g., the predetermined current) may be current (e.g., current by which) the organic light emitting diode OLED hardly emits light (e.g., does not emit much light). The reference current (e.g., the predetermined current) may be previously determined through pre-experiments.

The second to fourth gray scale voltages V01, V10 and V11 correspond to turn-on voltages at which the driving transistor DT is turned on. That is, the voltage difference (ELVDD−V01) between the high power voltage ELVDD and the second gray scale voltage V01 is lower than the threshold voltage of the driving transistor DT, and the voltage difference (ELVDD−V10) between the high power voltage ELVDD and the third gray scale voltage V10 is also lower than the threshold voltage of the driving transistor DT. The voltage difference (ELVDD−V11) between the high power voltage ELVDD and the fourth gray scale voltage V11 is also lower than the threshold voltage of the driving transistor DT. The turn-on voltage refers to a voltage at which the channel in the driving transistor DT is almost opened, i.e., a voltage in a period where the drain-source current is saturated. The saturation period of the drain-source current is a period in which 90% or more of the drain-source current flows. In FIG. 4, the saturation period of the drain-source current corresponds to a period in which the threshold voltage of the driving transistor DT is lower than the second gray scale voltage V01.

The first to fourth gray scale voltages V00, V01, V10 and V11 may have a difference by a set voltage (e.g., a predetermined voltage) from each other. For example, when each subfield is divided into p periods, a r-th (r is a positive integer satisfying $1 \le r \le p$) gray scale voltage may be a voltage higher or lower by the set voltage (e.g., by the predetermined voltage) than a (r+1)-th gray scale voltage. When each subfield is divided into the p periods, the set voltage (e.g., the predetermined voltage) corresponds to a voltage variation ΔVREF between a reference voltage in a q-th (q is a positive integer satisfying $1 \le q \le p$) period and a reference voltage in a (q−1)-th or (q+1)-th period that is a period adjacent to the q-th period. Hereinafter, for convenience of illustration, the voltage variation ΔVREF between the reference voltage in the q-th period and the reference voltage in the (q−1)-th or (q+1)-th period will be simply defined as a reference voltage variation.

FIG. 5 is a waveform diagram illustrating an example of a scan signal, a reference voltage and a data voltage, supplied to the pixel shown in FIG. 3. In FIG. 5, there are shown a k-th scan signal SCANk supplied to a k-th scan line SLk and a j-th data voltage DATAj supplied to a j-th data line Dj during an i-th subfield SFi. In addition, the reference voltage VREF supplied to the reference voltage line VREFL during the i-th subfield is shown in FIG. 5.

Referring to FIG. 5, the i-th subfield SFi is equally divided into p periods. Hereinafter, for convenience of illustration, the case where the i-th subfield SFi is equally divided into first to third periods t1, t2 and t3 as shown in FIG. 5 will be primarily described.

The first period t1 includes a data voltage supply period td. The data voltage supply period td is a period in which the first transistor ST1 of the pixel P is turned on by the k-th scan signal SCANk of a gate-on voltage Von of the k-th scan line SLk so that a data voltage Vdata of the j-th data line Dj is supplied to the first node N1 of the pixel P. The gate-on voltage Von corresponds to a turn-on voltage at which the first transistor ST1 is turned on, and a gate-off voltage correspond to a turn-off voltage at which the first transistor ST1 is turned off.

The reference voltage VREF is increased (e.g., raised) by the reference voltage variation ΔVREF every period of the first to third periods t1 to t3. Specifically, the reference voltage VREF is supplied as a first level voltage V1 during the first period t1, supplied as a second level voltage V2 during the second period t2, and supplied as a third level voltage V3 during the third period t3. The second level voltage V2 is a voltage higher by the reference voltage variation ΔVREF than the first level voltage V1, and the third level voltage V3 is a voltage higher by the reference voltage variation ΔVREF than the second level voltage V2. That is, the reference voltage VREF in the (q+1)-th period is higher by the reference voltage variation ΔVREF than that in the q-th period.

The reference voltage variation ΔVREF is set to a voltage higher than the minimum of the difference voltage between the turn-on voltage and the turn-off voltage of the driving transistor DT. When the reference voltage variation ΔVREF is lower than the minimum of the difference voltage between the turn-on voltage and the turn-off voltage of the driving transistor DT, the pixel P according to this embodiment emits light even though the pixel P is not to emit light.

Hereinafter, the operation of the pixel P during the first to third periods t1 to t3 when the data voltage Vdata is supplied as any one of the first to fourth gray scale voltages V00, V01, V10 and V11 will be described in detail with reference to FIGS. 3 to 5.

First, when the first gray scale voltage V00 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the first gray scale voltage V00 of the j-th data line Dj to the first node N1. The first gray scale voltage V00 corresponds to a turn-off voltage at which the driving transistor DT is turned off, and thus the driving transistor DT is turned off during the first period t1. In addition, the reference voltage VREF is supplied as the first level voltage V1 during the first period t1.

During the second period t2, the reference voltage VREF is supplied as a second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes a voltage obtained by adding up the first gray scale voltage V00 and the reference voltage variation ΔVREF during the second period t2.

When the voltage of the first node N1 is higher than the difference voltage (ELVDD−Vth2) between the high power voltage ELVDD and the threshold voltage Vth2 of the second transistor ST2, the second transistor ST2 is turned on. Thus, the voltage of the first node N1 is discharged to the difference voltage between the high power voltage ELVDD and the threshold voltage Vth2 of the second transistor ST2. Accordingly, the driving transistor DT is turned off during the second period t2.

During the third period t3, the reference voltage VREF is supplied as the third level voltage V3. The third level voltage V3 applied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3.

When the voltage of the first node N1 is higher than the difference voltage (ELVDD−Vth2) between the high power voltage ELVDD and the threshold voltage Vth2 of the second transistor ST2, the second transistor ST2 is turned on. Thus, the voltage of the first node N1 is discharged to the difference voltage between the high power voltage ELVDD and the threshold voltage Vth2 of the second transistor ST2. Accordingly, the driving transistor DT is turned off during the third period t3.

When the gate voltage Vg of the driving transistor DT formed of a P-type MOSFET is higher than the first gray scale voltage V00 as shown in FIG. 4, the drain-source current Ids of the driving transistor DT is increased (e.g., raised) in proportion to the gate voltage Vg of the driving transistor DT even though the driving transistor DT is turned off. That is, the driving transistor DT leaks a current (e.g., a predetermined current), and therefore, the organic light emitting diode OLED may slightly emit light. However, in this embodiment, the voltage of the first node N1 is maintained by the second transistor ST2 to a level lower than that of the difference voltage (ELVDD−Vth2) between the high power voltage ELVDD and the threshold voltage Vth2 of the second transistor ST2. Thus, in this embodiment, it is possible to decrease (e.g., minimize) leakage of the drain-source current Ids of the driving transistor DT during the second and third periods t2 and t3.

As described above, in this embodiment, when the first gray scale voltage V00 is supplied to the j-th data line Dj, in synchronization with the k-th scan signal SCANk, the driving transistor DT is turned off during the first to third periods t1 to t3. Thus, the organic light emitting diode OLED does not emit light during the first to third periods t1 to t3, and accordingly, the pixel P does not emit light during the first to third periods t1 to t3.

Second, when the second gray scale voltage V01 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the second gray scale voltage V01 of the j-th data line Dj to the first node N1. Thus, the driving transistor DT is turned on during the first period t1. In addition, the reference voltage VREF is supplied as the first level voltage V1 during the first period t1.

During the second period t2, the reference voltage VREF is supplied as the second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes the first gray scale voltage V00 that is a voltage obtained by adding up the second gray scale voltage V01 and the reference voltage variation ΔVREF during the second period t2. Thus, the driving transistor DT is turned off during the second period t2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (or reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node N1 becomes a voltage (V00+ΔVREF) obtained by adding up the first gray scale voltage V00 and the reference voltage variation ΔVREF.

When the voltage of the first node N1 is higher than the difference voltage (ELVDD−Vth2) between the high power voltage ELVDD and the threshold voltage Vth2 of the second transistor ST2, the second transistor ST2 is turned on. Thus, the voltage of the first node N1 is discharged to the difference voltage (ELVDD−Vth2) between the high power voltage ELVDD and the threshold voltage Vth2 of the second transistor ST2. Accordingly, the driving transistor DT is turned off during the third period t3.

As described above, in this embodiment, when the second gray scale voltage V01 is supplied to the j-th data line Dj, in synchronization with the k-th scan signal SCANk, the driving transistor DT is turned on during the first period t1, and turned off during the second and third periods t2 and t3. Thus, the organic light emitting diode OLED of the pixel P emits light during the first period t1, and does not emit light during the second and third periods t2 and t3. That is, the pixel P emits light during the first period t1, and does not emit light during the second and third periods t2 and t3.

In this embodiment, the voltage of the first node N1 is maintained by the second transistor ST2 to a level lower than that of the difference voltage (ELVDD−Vth2) between the high power voltage ELVDD and the threshold voltage Vth2 of the second transistor ST2. Thus, in this embodiment, it is possible to decrease (e.g., minimize) leakage of the drain-source current of the driving transistor DT during the third period t3.

Third, when the third gray scale voltage V10 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the third gray scale voltage V10 of the j-th data line Dj to the first node N1. Thus, the driving transistor DT is turned on during the first period t1. In addition, the reference voltage VREF is supplied as the first level voltage V1 during the first period t1.

During the second period t2, the reference voltage VREF is supplied as the second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes the second gray scale voltage V01 that is a voltage obtained by adding up the third gray scale voltage V10 and the reference voltage variation ΔVREF during the second period t2. Thus, the driving transistor DT is turned on during the second period t2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node N1 becomes the first gray scale voltage V00 that is a voltage obtained by adding up the second gray scale voltage V01 and the reference voltage variation ΔVREF during the third period t3. Thus, the driving transistor DT is turned off during the third period t3.

As described above, in this embodiment, when the third gray scale voltage V10 is supplied to the j-th data line Dj, in synchronization with the k-th scan signal SCANk, the driving transistor DT is turned on during the first and second periods t1 and t2, and turned off during the third period t3. Thus, the organic light emitting diode OLED of the pixel P emits light during the first and second periods t1 and t2, and does not emit light during the third period t3. That is, the pixel P emits light during the first and second periods t1 and t2, and does not emit light during the third period t3.

Fourth, when the fourth gray scale voltage V11 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the fourth gray scale voltage V11 of the j-th data line Dj to the first node N1. Thus, the driving transistor DT is turned on during the first period t1. In addition, the reference voltage VREF is supplied as the first level voltage during the first period t1.

During the second period t2, the reference voltage VREF is supplied as the second level voltage V2. The second level voltage V2 supplied during the second period is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling by the capacitor coupled between the first node N1 and the reference voltage line VREFL. Thus, the voltage of the first node N1 is increased (e.g., raised) by the reference voltage variation ΔVREF during the second period t2. That is, the voltage of the first node N1 becomes the third gray scale voltage V10 that is a voltage obtained by adding up the fourth gray scale voltage V11 and the reference voltage variation ΔVREF during the second period t2. Thus, the driving transistor DT is turned on during the second period t2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node N1 becomes the second level voltage V01 that is a voltage obtained by adding up the third gray scale voltage V10 and the reference voltage variation ΔVREF during the third period t3. Thus, the driving transistor DT is turned on during the third period t3.

As described above, in this embodiment, when the fourth gray scale voltage V11 is supplied to the j-th data line Dj, in synchronization with the k-th scan signal SCANk, the driving transistor DT is turned on during the first to third periods t1 to t3. Thus, the organic light emitting diode OLED of the pixel P emits light during the first to third periods t1 to t3. That is, the pixel P emits light during the first to third periods t1 to t3.

As a result, the pixel P can represent any one of (p+1) gray scale levels during the i-th subfield SFi according to which gray scale voltage the pixel P receives among the first to (p+1)-th gray scale levels. Thus, in this embodiment, when the one frame is divided into h (h is a positive integer of 2 or more) subfields for driving the organic light emitting display, the pixel P can be implemented to represent $(p+1)^h$ gray scale levels.

Conventionally, each pixel expressed two gray scale levels in each subfield. However, in this embodiment, each pixel can express three or more gray scale levels in each subfield. Thus, in this embodiment, it is possible to reduce the number of subfields included in the one frame.

Figure 6:
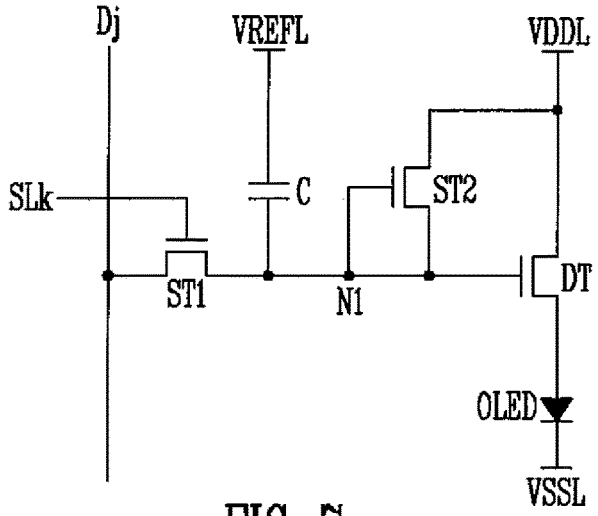
FIG. 6 is an equivalent circuit diagram of a pixel according to a second embodiment of the present invention.

FIG. 6 is an equivalent circuit diagram of a pixel according to a second embodiment of the present invention.

Referring to FIG. 6, the pixel P is coupled to the k-th scan line and the j-th data line. In addition, the pixel P is coupled to the high power voltage line VDDL, the low power voltage line VSSL and the reference voltage line VREFL.

The pixel P includes a driving transistor DT, an organic light emitting diode OLED, a plurality of transistors, a capacitor C, and the like. The plurality of transistors may include first and second transistors ST1 and ST2.

The driving transistor DT, the organic light emitting diode OLED, the first transistor ST1 and the capacitor C of the pixel P according to the second embodiment of the present invention is substantially identical to those of the pixel P according to the first embodiment of the present invention, except that the driving transistor DT and the first transistor ST1 are formed of N-type MOSFETs. Therefore, the detailed descriptions of the driving transistor DT, the organic light emitting diode OLED, the first transistor ST1 and the capacitor C according to the second embodiment of the present invention will be omitted.

The second transistor ST2 is coupled between the first node N1 and the high power voltage line VDDL. A gate electrode and a first electrode of the second transistor ST2 are coupled to the first node N1, and a second electrode of the second transistor ST2 is coupled to the high power voltage line VDDL.

The second transistor ST2 is formed of an N-type MOSFET, and thus is turned on when its gate-source voltage V is higher than its threshold voltage Vth2 (Vgs>Vth2). That is, the second transistor ST2 is turned on when the difference voltage between the voltage of the first node N1, which is a gate voltage, and the high power voltage ELVDD that is a source voltage is higher than the threshold voltage Vth2. As the second transistor ST2 is turned on, the first node N1 is coupled to the high power voltage line VDDL. In this case, the voltage of the first node N1 is discharged to a voltage (ELVDD+Vth2) obtained by adding the high power voltage ELVDD and the threshold voltage Vth2 of the second transistor ST2. As a result, the second transistor ST2 performs a function of maintaining the voltage of the first node N1 not to be greater than the voltage (ELVDD+Vth2) obtained by adding the high power voltage ELVDD and the threshold voltage Vth2 of the second transistor ST2.

Figure 7:
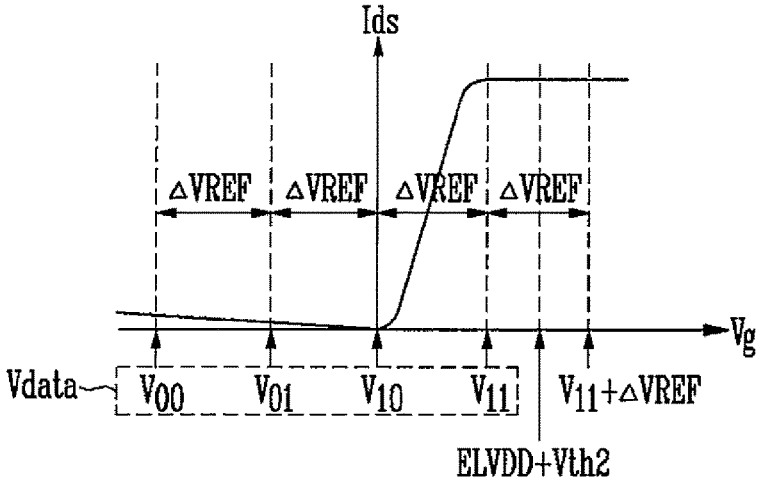
FIG. 7 is an example diagram illustrating drain-source current with respect to a gate voltage of a driving transistor in the pixel according to the second embodiment of the present invention.

FIG. 7 is an example diagram illustrating drain-source current with respect to a gate voltage of the driving transistor in the pixel according to the second embodiment of the present invention. In FIG. 7, the x-axis corresponds to gate voltages Vg of the driving transistor DT, and the y-axis corresponds to drain-source currents Ids. In the graph of FIG. 7, the case where the driving transistor DT is formed of an N-type MOSFET as shown in FIG. 6 has been primarily illustrated.

Figure 8:
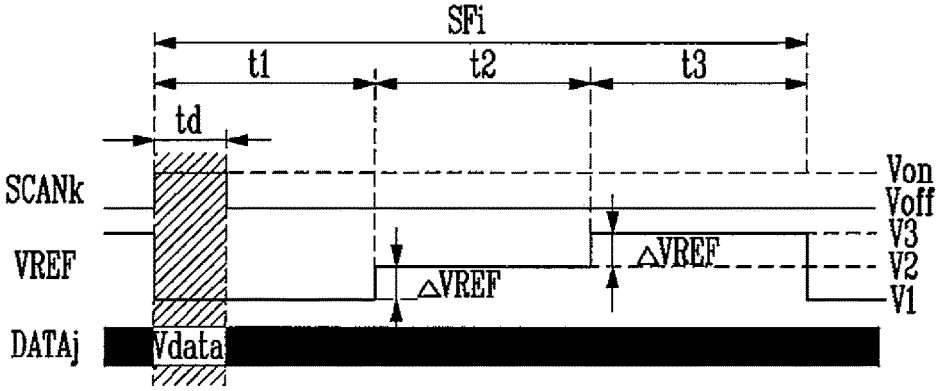
FIG. 8 is a waveform diagram illustrating an example of a scan signal, a reference voltage and a data voltage supplied to the pixel shown in FIG. 6.

One frame period is divided into a plurality of subfields, and each subfield is divided into p periods as shown in FIG. 8. In this case, the data voltage may be supplied as any one gray scale voltage among p+1 gray scale voltages. For convenience of illustration, the case where the one frame is divided into three subfields, and the data voltage is supplied as any one gray scale voltage among four gray scale voltages, i.e., first to fourth gray scale voltages V00, V01, V10 and V11, has been primarily described in FIG. 7. P periods of each subfield will be described in detail later with reference to FIG. 8.

Referring to FIG. 7, the driving transistor DT is formed of an N-type MOSFET. Thus, the driving transistor DT may be turned on when its gate-source voltage Vgs is higher than its threshold voltage, and be turned off when its gate-source voltage Vgs is lower than or equal to its threshold voltage.

The first to third gray scale voltages V00, V01 and V10 correspond to turn-off voltages at which the driving transistor DT is turned off. That is, the voltage difference (ELVDD−V00) between the high power voltage ELVDD and the first gray scale voltage V00 is lower than or equal to the threshold voltage of the driving transistor DT, and the voltage difference (ELVDD−V01) between the high power voltage ELVDD and the second gray scale voltage V01 is lower than or equal to the threshold voltage of the driving transistor DT. The voltage difference (ELVDD−V10) between the high power voltage ELVDD and the third gray scale voltage V10 is lower than or equal to the threshold voltage of the driving transistor DT. The turn-off voltage refers to a voltage allowing the drain-source current Ids of the driving transistor DT, a voltage lower than a reference current (e.g., a predetermined current), to flow. The reference current may be current to an extent where the organic light emitting diode OLED hardly emits light. The reference current may be previously determined through pre-experiments.

The fourth gray scale voltage V11 corresponds to a turn-on voltage at which the driving transistor DT is turned on. That is, the voltage difference (ELVDD−V11) between the high power voltage ELVDD and the fourth gray scale voltage V11 is higher than the threshold voltage of the driving transistor DT. The turn-on voltage refers to a voltage at which the channel in the driving transistor DT is almost opened, i.e., a voltage in a period where the drain-source current is saturated. The saturation period of the drain-source current is a period in which 90% or more of the drain-source current flows. In FIG. 7, the saturation period of the drain-source current corresponds to a period in which the threshold voltage of the driving transistor DT is higher than the fourth gray scale voltage V11.

The first to fourth gray scale voltages V00, V01, V10 and V11 may have a difference by a set voltage from each other. For example, when each subfield is divided into p periods, an r-th (r is a positive integer satisfying $1 \le r \le p$) gray scale voltage may be a voltage higher or lower by the set voltage than an (r+1)-th gray scale voltage. When each subfield is divided into the p periods, the set voltage corresponds to a voltage variation ΔVREF between a reference voltage in a q-th (q is a positive integer satisfying $1 \le q \le p$) period and a reference voltage in a (q−1)-th or (q+1)-th period that is a period adjacent to the q-th period. Hereinafter, for convenience of illustration, the voltage variation ΔVREF between the reference voltage in the q-th period and the reference voltage in the (q−1)-th or (q+1)-th period will be simply defined as a reference voltage variation.

FIG. 8 is a waveform diagram illustrating an example of a scan signal, a reference voltage and a data voltage, supplied to the pixel shown in FIG. 6. In FIG. 8, there are shown a k-th scan signal SCANk supplied to a k-th scan line SLk and a j-th data voltage DATAj supplied to a j-th data line Dj during an i-th subfield SFi. In addition, the reference voltage VREF supplied to the reference voltage line VREFL during the i-th subfield is shown in FIG. 8.

Referring to FIG. 8, the i-th subfield SFi is equally divided into p periods. Hereinafter, for convenience of illustration, the case where the i-th subfield SFi is equally divided into first to third periods t1, t2 and t3 as shown in FIG. 8 will be primarily described.

The k-th scan signal SCANk, the j-th data voltage DATAj and the reference voltage VREF, shown in FIG. 8, are substantially identical to those shown in FIG. 5, except that the gate-on voltage Von of the k-th scan signal SCANk is a voltage having a level higher than that of the gate-off voltage Voff. Therefore, the detailed descriptions of the k-th scan signal SCANk, the j-th data voltage DATAj and the reference voltage VREF, shown in FIG. 8, will be omitted.

Hereinafter, the operation of the pixel P during the first to third periods t1 to t3 when the data voltage Vdata is supplied as any one of the first to fourth gray scale voltages V00, V01, V10 and V11 will be described in detail with reference to FIGS. 6 to 8.

First, when the first gray scale voltage V00 is supplied to the j-th data line Dj, in synchronization with the k-th scan signal SCANk, the operation of the pixel P will be described.

During the data voltage supply period td of the first period t1, the first transistor ST1 is turned on by the k-th scan signal SCANk to supply the first gray scale voltage V00 of the j-th data line Dj to the first node N1. The first gray scale voltage V00 corresponds to a turn-off voltage at which the driving transistor DT is turned off, and thus the driving transistor DT is turned off during the first period t1. In addition, the reference voltage VREF is supplied as the first level voltage V1 during the first period.

During the second period t2, the reference voltage VREF is supplied as the second level voltage V2. The second level voltage V2 supplied during the second period t2 is higher by the reference voltage variation ΔVREF than the first level voltage V1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 becomes the second gray scale voltage V01 that is a voltage obtained by adding up the first gray scale voltage V00 and the reference voltage variation ΔVREF. The second gray scale voltage V01 corresponds to a turn-off voltage at which the driving transistor DT is turned off, and thus the driving transistor DT is turned off during the second period t2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage VREF. Thus, the voltage of the first node N1 is increased (e.g., raised) by the reference voltage variation ΔVREF during the third period t3. That is, the voltage of the first node N1 becomes the third gray scale voltage V10 that is a voltage obtained by adding up the second gray scale value V01 and the reference voltage variation ΔVREF during the third period t3. The third gray scale voltage V10 corresponds to a turn-off voltage at which the driving transistor DT is turned off, and thus the driving transistor DT is turned off during the third period t3.

As described above, in this embodiment, when the first gray scale voltage V00 is supplied to the j-th data line Dj, in synchronization with the k-th scan signal SCANk, the driving transistor DT is turned off during the first to third periods t1 to t3. Thus, the organic light emitting diode OLED of the pixel P does not emit light during the first to third periods t1 to t3. That is, the pixel P does not emit light during the first to third periods t1 to t3.

Second, when the second gray scale voltage V01 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the gray scale voltage V01 of the j-th data line Dj to the first node N1. The second gray scale voltage V01 corresponds to a turn-off voltage at which the driving transistor DT is turned off, and thus the driving transistor DT is turned off during the first period t1. In addition, the reference voltage VREF is supplied as the first level voltage V1 during the first period t1.

During the second period t2, the reference voltage VREF is supplied as the second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes the third gray scale voltage V10 that is a voltage obtained by adding up the second gray scale voltage V01 and the reference voltage variation ΔVREF during the second period t2. The third gray scale voltage V10 corresponds to a turn-off voltage at which the driving transistor DT is turned off, and thus the driving transistor DT is turned off during the second period t2.

During the third period t3, the reference voltage VREF is supplied as the third level voltage V3. The third level V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node. N1 becomes the fourth gray scale voltage V11 that is a voltage obtained by adding up the third gray scale voltage V10 and the reference voltage variation ΔVREF during the third period t3. Thus, the driving transistor DT is turned on during the third period t3.

As described above, in this embodiment, when the second gray scale voltage V01 is supplied to the j-th data line Dj, in synchronization with the k-th scan signal SCANk, the driving transistor DT is turned off during the first and second periods t1 and t2, and turned on during the third period t3. Thus, the organic light emitting diode OLED of the pixel P does not emit light during the first and second periods t1 and t2, and emits light during the third period t3. That is, the pixel P does not emit light during the first and second periods t1 and t2, and emits light during the third period t3.

Third, when the third gray scale voltage V10 is supplied to the j-th data line Dj, in synchronization with the scan signal SCANk, the operation of the pixel P during the first to third periods t1 to t3 will be described.

During the data voltage supply period td of the first period, the first transistor ST1 is turned on by the k-th scan signal SCANk to supply the third gray scale voltage V10 of the j-th data line Dj to the first node N1. The third gray scale voltage V10 corresponds to a turn-off voltage at which the driving transistor DT is turned off, and thus the driving transistor DT is turned off during the first period t1. In addition, the reference voltage VREF is supplied as the first level voltage V1 during the first period t1.

During the second period t2, the reference voltage VREF is supplied as the second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes the fourth gray scale voltage V11 that is a voltage obtained by adding up the third gray scale voltage V10 and the reference voltage variation ΔVREF during the second period t2. Thus, the driving transistor DT is turned on during the second period t2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node N1 becomes a voltage (V11+ΔVREF) obtained by adding up the fourth gray scale value V11 and the reference voltage variation ΔVREF during the third period t3. Thus, the driving transistor DT is turned on during the third period t3.

When the voltage of the first node N1 is higher than the voltage (ELVDD+Vth2) obtained by adding up the high power voltage ELVDD and the threshold voltage Vth2 of the second transistor ST2, the second transistor ST2 is turned on. Thus, the voltage of the first node N1 is discharged to the voltage (ELVDD+Vth2) obtained by adding up the high power voltage ELVDD and the threshold voltage Vth2 of the second transistor ST2. That is, the voltage of the first node N1 is maintained by the second transistor ST2 to have a level lower than that of the voltage (ELVDD+Vth2) obtained by adding up the high power voltage ELVDD and the threshold voltage Vth2 of the second transistor ST2.

When the voltage of the first node N1 is greater than the voltage (V11+ΔVREF) obtained by adding up the fourth gray scale value V11 and the reference voltage variation ΔVREF, the range of a voltage applied to the gate electrode Vg of the driving transistor DT is excessively widened. In order to reduce or prevent such a problem, in this embodiment, the voltage of the first node N1 is maintained to a level lower than that of the voltage (ELVDD+Vth2) obtained by adding up the high power voltage ELVDD and the threshold voltage Vth2 of the second transistor ST2. Thus, in this embodiment, it is possible to control the range of the voltage applied to the gate electrode Vg of the driving transistor DT not to be excessively widened.

As described above, in this embodiment, when the third gray scale voltage V10 is supplied to the j-th data line Dj, in synchronization with the k-th scan signal SCANk, the driving transistor DT is turned off during the first period t1, and turned on during the second and third periods t2 and t3. Thus, the organic light emitting diode OLED of the pixel P does not emit light during the first period t1, and emits light during the second and third periods t2 and t3. That is, the pixel P does not emit light during the first period t1, and emits light during the second and third periods t2 and t3.

Fourth, when the fourth gray scale voltage V11 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the fourth gray scale voltage V11 of the j-th data line Dj to the first node N1. Thus, the driving transistor DT is turned on during the first period V1. In addition, the reference voltage VREF is supplied as the first level voltage V1.

During the second period t2, the reference voltage VREF is supplied as the second level voltage V2. The second level voltage V2 supplied during the second period t2 is higher by the reference voltage variation ΔVREF than the first level voltage V1 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the second period t2. That is, the voltage of the first node N1 becomes a voltage (V11+ΔVREF) obtained by adding up the fourth gray scale voltage V11 and the reference voltage variation ΔVREF during the second period t2. Thus, the driving transistor DT is turned on during the second period t2.

When the voltage of the first node N1 is higher than the voltage ELVDD+Vth2 obtained by adding up the high power voltage ELVDD and the threshold voltage Vth2 of the second transistor ST2, the second transistor ST2 is turned on. Thus, the voltage of the first node N1 is discharged to the voltage ELVDD+Vth2 obtained by adding up the high power voltage ELVDD and the threshold voltage Vth2 of the second transistor ST2. That is, the voltage of the first node N1 is maintained by the second transistor ST2 to have a level lower than that of the voltage ELVDD+Vth2 obtained by adding up the high power voltage ELVDD and the threshold voltage Vth2 of the second transistor ST2.

During the third period t3, the reference voltage VREF is supplied as the third level voltage V3. The third level voltage V3 supplied during the third period t3 is higher by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is increased (e.g., raised) by the reference voltage variation ΔVREF during the third period t3. That is, the voltage of the first node N1 becomes a voltage (V11+(2×ΔVREF)) obtained by adding the reference voltage variation ΔVREF to the voltage (V11+ΔVREF) obtained by adding up the fourth gray scale voltage V11 and the reference voltage variation ΔVREF during the third period t3. Accordingly, the driving transistor DT is turned on during the third period t3.

When the voltage of the first node N1 is higher than the voltage (ELVDD+Vth2) obtained by adding up the high power voltage ELVDD and the threshold voltage Vth2 of the second transistor ST2, the second transistor ST2 is turned on. Thus, the voltage of the first node N1 is discharged to the voltage (ELVDD+Vth2) obtained by adding up the high power voltage ELVDD and the threshold voltage Vth2 of the second transistor ST2. That is, the voltage of the first node N1 is maintained by the second transistor ST2 to have a level lower than that of the voltage (ELVDD+Vth2) obtained by adding up the high power voltage ELVDD and the threshold voltage Vth2 of the second transistor ST2.

As described above, in this embodiment, when the fourth gray scale voltage V11 is supplied to the j-th data line Dj, in synchronization with the k-th scan signal SCANk, the driving transistor DT is turned on during the first to third periods t1 to t3. Thus, the organic light emitting diode OLED of the pixel P emits light during the first to third periods t1 to t3. That is, the pixel P emits light during the first to third periods t1 to t3.

In this embodiment, the voltage of the first node N1 is maintained to a level lower than that of the voltage (ELVDD+Vth2) obtained by adding up the high power voltage ELVDD and the threshold voltage Vth2 of the second transistor ST2, using the second transistor ST2. Thus, in this embodiment, it is possible to control the range of the voltage applied to the gate electrode Vg of the driving transistor DT not to be excessively widened.

As a result, the pixel P can express any one of p+1 gray scale levels during the i-th subfield SFi according to which gray scale voltage the pixel P receives among the first to (p+1)-th gray scale levels. Thus, in this embodiment, when the one frame is divided into h (h is a positive integer of 2 or more) subfields for driving the organic light emitting display, the pixel P can be implemented to express $(p+1)^h$ gray scale levels.

Conventionally, each pixel expressed two gray scale levels in each subfield. However, in this embodiment, each pixel can express three or more gray scale levels in each subfield. Thus, in this embodiment, it is possible to reduce the number of subfields included in the one frame.

Figure 9:
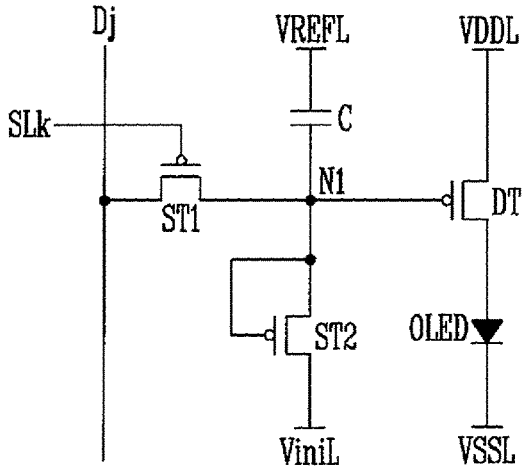
FIG. 9 is an equivalent circuit diagram of a pixel according to a third embodiment of the present invention.

FIG. 9 is an equivalent circuit diagram of a pixel according to a third embodiment of the present invention.

Referring to FIG. 9, the pixel P is coupled to the k-th scan line and the j-th data line. In addition, the pixel P is coupled to the high power voltage line VDDL, the low power voltage line VSSL and the reference voltage line VREFL.

The pixel P includes a driving transistor DT, an organic light emitting diode OLED, a plurality of transistors, a capacitor C, and the like. The plurality of transistors may include first and second transistors ST1 and ST2.

The pixel P according to the third embodiment of the present invention is substantially identical to that according to the first embodiment of the present invention, except for the second transistor ST2. Therefore, the detailed descriptions of the driving transistor DT, the organic light emitting diode OLED, the first transistor ST1 and the capacitor C of the pixel P according to the third embodiment of the present invention will be omitted.

Referring to FIG. 9, the second transistor ST2 is coupled between the first node N1 and an initialization voltage line ViniL. A gate electrode and a first electrode of the second transistor ST2 are coupled to the first node N1, and a second electrode of the second transistor ST2 is coupled to the initialization voltage line ViniL. That is, the second transistor ST2 is diode-coupled.

The second transistor ST2 is formed of a P-type MOSFET, and thus is turned on when its gate-source voltage Vgs is lower than its threshold voltage Vth2. That is, the voltage difference between the voltage of the first node N1, which is a gate voltage, and an initialization voltage Vini that is a source voltage is lower than the threshold voltage Vth2, the second transistor ST2 is turned on. As the second transistor ST2 is turned on, the first node N is coupled to the initialization voltage line ViniL. In this case, the voltage of the first node N1 is charged to a voltage Vini+Vth2 obtained by adding up the initialization voltage Vini and the threshold voltage Vth2 of the second transistor ST2. As a result, the second transistor ST2 performs a function of maintaining the voltage of the first node N not to be lower than the voltage Vini+Vth2 obtained by adding up the initialization voltage Vini and the threshold voltage Vth2 of the second transistor ST2.

Figure 10:
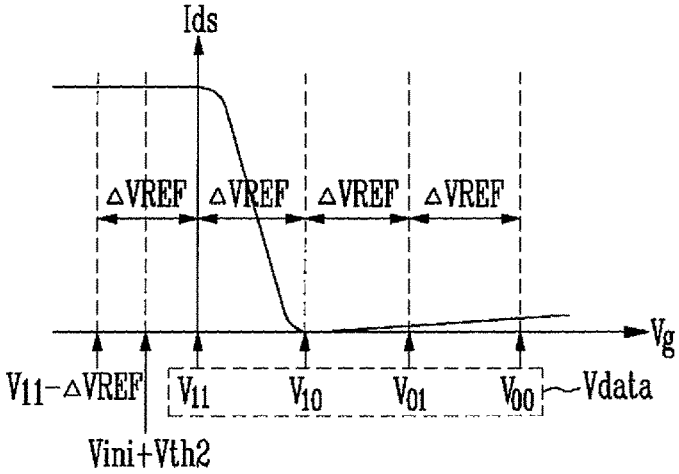
FIG. 10 is an example diagram illustrating drain-source current with respect to a gate voltage of a driving transistor in the pixel according to the third embodiment of the present invention.

FIG. 10 is an example diagram illustrating drain-source current with respect to a gate voltage of the driving transistor in the pixel according to the third embodiment of the present invention. In FIG. 10, the x-axis corresponds to gate voltages Vg of the driving transistor DT, and the y-axis corresponds to drain-source currents Ids. In the graph of FIG. 10, the case where the driving transistor DT is formed of a P-type MOSFET as shown in FIG. 9 has been primarily illustrated.

Figure 11:
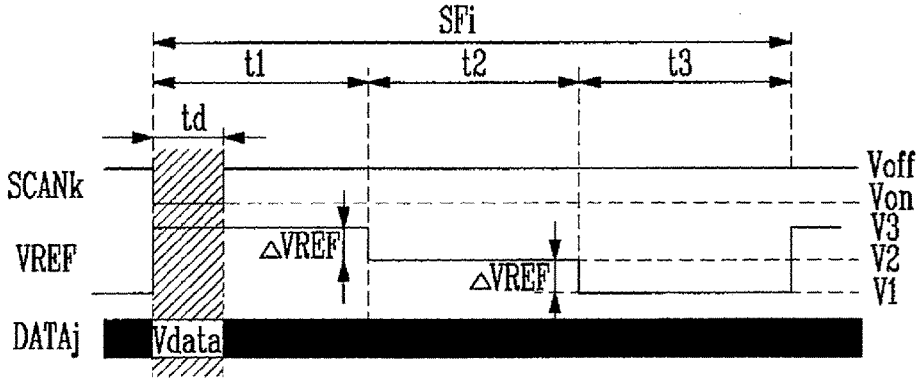
FIG. 11 is a waveform diagram illustrating an example of a scan signal, a reference voltage and a data voltage supplied to the pixel shown in FIG. 9.

One frame period is divided into a plurality of subfields, and each subfield is divided into p periods as shown in FIG. 11. In this case, the data voltage may be supplied as any one gray scale voltage among p+1 gray scale voltages. For convenience of illustration, the case where the one frame is divided into three subfields, and the data voltage is supplied as any one gray scale voltage among four gray scale voltages, i.e., first to fourth gray scale voltages V00, V01, V10 and V11 has been primarily described in FIG. 10. P periods of each subfield will be described in detail later with reference to FIG. 11.

Referring to FIG. 10, the driving transistor DT is formed of a P-type MOSFET. Thus, the driving transistor DT may be turned on when its gate-source voltage Vgs is lower than its threshold voltage, and be turned off when its gate-source voltage Vgs is higher than or equal to its threshold voltage.

The first to third gray scale voltages V00, V01 and V10 correspond to turn-off voltages at which the driving transistor DT is turned off. That is, the voltage difference (ELVDD−V00) between the high power voltage ELVDD and the first gray scale voltage V00 is lower than or equal to the threshold voltage of the driving transistor DT, and the voltage difference (ELVDD−V01) between the high power voltage ELVDD and the second gray scale voltage V01 is lower than or equal to the threshold voltage of the driving transistor DT. The voltage difference (ELVDD−V10) between the high power voltage ELVDD and the third gray scale voltage V10 is lower than or equal to the threshold voltage of the driving transistor DT. The turn-off voltage means a voltage allowing the drain-source current Ids of the driving transistor DT, lower than a reference current (e.g., a predetermined current), to flow. The reference current may be current to an extent where (e.g., by which) the organic light emitting diode OLED hardly emits light (e.g., does not emit much light). The reference current may be previously determined through pre-experiments.

The fourth gray scale voltage V11 corresponds to a turn-on voltage at which the driving transistor DT is turned on. That is, the voltage difference (ELVDD−V11) between the high power voltage ELVDD and the fourth gray scale voltage V11 is higher than the threshold voltage of the driving transistor DT. The turn-on voltage means a voltage at which the channel in the driving transistor DT is almost opened, i.e., a voltage in a period where the drain-source current is saturated. The saturation period of the drain-source current is a period in which 90% or more of the drain-source current flows. In FIG. 10, the saturation period of the drain-source current corresponds to a period in which the threshold voltage of the driving transistor DT is higher than the fourth gray scale voltage V11.

The first to fourth gray scale voltages V00, V01, V10 and V11 may have a difference by a set voltage (e.g., a predetermined voltage) from each other. For example, when each subfield is divided into p periods, an r-th (r is a positive integer satisfying $1 \le r \le p$) gray scale voltage may be a voltage higher or lower by the set voltage than an (r+1)-th gray scale voltage. When each subfield is divided into the p periods, the set voltage corresponds to a voltage variation ΔVREF between a reference voltage in a q-th (q is a positive integer satisfying 1≤q≤p) period and a reference voltage in a (q−1)-th or (q+1)-th period that is a period adjacent to the q-th period. Hereinafter, for convenience of illustration, the voltage variation ΔVREF between the reference voltage in the q-th period and the reference voltage in the (q−1)-th or (q+1)-th period will be simply defined as a reference voltage variation.

FIG. 11 is a waveform diagram illustrating an example of a scan signal, a reference voltage and a data voltage, supplied to the pixel of FIG. 9. In FIG. 8, there are shown a k-th scan signal SCANk supplied to a k-th scan line SLk and a j-th data voltage DATAj supplied to a j-th data line Dj during an i-th subfield SFi. In addition, the reference voltage VREF supplied to the reference voltage line VREFL during the i-th subfield is shown in FIG. 8.

Referring to FIG. 11, the i-th subfield SFi is equally divided into p periods. Hereinafter, for convenience of illustration, the case where the i-th subfield SFi is equally divided into first to third periods t1, t2 and t3 as shown in FIG. 11 will be primarily described.

The k-th scan signal SCANk, and the j-th data voltage DATAj, shown in FIG. 11, are substantially identical to those shown in FIG. 5. Therefore, the detailed descriptions of the k-th scan signal SCANk and the j-th data voltage DATAj, shown in FIG. 11, will be omitted.

The reference voltage VREF is lowered by the reference voltage variation ΔVREF every period of the first to third periods t1 to t3. Specifically, the reference voltage VREF is supplied as the third level voltage V3 during the first period t1, supplied as the second level voltage V2 during the second period, and supplied as the first level voltage V1 during the third period t3. The second level voltage V2 is a voltage higher by the reference voltage variation ΔVREF than the first level voltage V1, and the third level voltage V3 is a voltage higher by the reference voltage variation ΔVREF than the second level voltage V2. That is, the reference voltage VREF in the (q+1)-th period is lower by the reference voltage variation ΔVREF than that in the q-th period.

The reference voltage variation ΔVREF is set to a voltage higher than the minimum of the difference voltage between the turn-on voltage and the turn-off voltage of the driving transistor DT. When the reference voltage variation ΔVREF is lower than the minimum of the difference voltage between the turn-on voltage and the turn-off voltage of the driving transistor DT, the pixel P according to this embodiment emits light even though the pixel P is not to emit light.

Hereinafter, the operation of the pixel P during the first to third periods t1 to t3 when the data voltage Vdata is supplied as any one of the first to fourth gray scale voltages V00, V01, V10 and V11 will be described in detail with reference to FIGS. 9 to 11.

First, when the first gray scale voltage V00 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the first gray scale voltage V00 of the j-th data line Dj to the first node N1. The first gray scale voltage V00 corresponds to a turn-off voltage at which the driving transistor DT is turned off, and thus the driving transistor DT is turned off during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the second gray scale voltage V01 that is a voltage obtained by subtracting the reference voltage variation ΔVREF from the first gray scale voltage V00 during the second period t2. The second gray scale voltage V01 corresponds to a turn-off voltage at which the driving transistor DT is turned off, and thus the driving transistor DT is turned off during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node is decreased (e.g., dropped) by the reference voltage variation ΔVREF during the third period t3. That is, the voltage of the first node N1 becomes the third gray scale voltage V10 that is a voltage obtained by subtracting the reference voltage variation ΔVREF from the second gray scale voltage V01 during the third period t3. The third gray scale voltage V10 corresponds to a turn-off voltage at which the driving transistor DT is turned off, and thus the driving transistor DT is turned off during the third period t3.

As described above, in this embodiment, when the first gray scale voltage V00 is supplied to the j-th data line Dj, in synchronization with the scan signal SCANk, the driving transistor DT is turned off during the first to third periods t1 to t3. Thus, the organic light emitting diode OLED of the pixel P does not emit light during the first to third periods t1 to t3. That is, the pixel P does not emit light during the first to third period t1 to t3.

Second, when the second gray scale voltage V01 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the second gray scale voltage V01 of the j-th data line Dj to the first node N1. The second gray scale voltage V01 corresponds to a turn-off voltage at which the driving transistor DT is turned off, and thus the driving transistor DT is turned off during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the third gray scale voltage V10 that is a voltage obtained by subtracting the reference voltage variation ΔVREF from the second gray scale voltage V01 during the second period t2. The third gray scale V10 corresponds to a turn-off voltage at which the driving transistor DT is turned off, and thus the driving transistor DT is turned off during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes the fourth gray scale voltage V11 that is a voltage obtained by subtracting the reference voltage variation ΔVREF from the third gray scale voltage V10. Thus, the driving transistor DT is turned on during the third period t3.

As described above, in this embodiment, when the second gray scale voltage V01 is supplied to the j-th data line Dj, in synchronization with the k-th scan signal SCANk, the driving transistor DT is turned off during the first and second periods t1 and t2, and turned on during the third period t3. Thus, the organic light emitting diode OLED of the pixel P does not emit light during the first and second periods t1 and t2, and emits light during the third period t3. That is, the pixel P does not emit light during the first and second periods t1 and t2, and emits light during the third period t3.

Third, when the third gray scale voltage V10 is supplied to the j-th data line Dj, in synchronization with the k-th scan line SCANk, the operation of the pixel P during the first to third periods t1 to t3 will be described.

During the data voltage supply period td of the first period t1, the first transistor ST1 is turned on by the k-th scan signal SCANk to supply the third gray scale voltage V3 of the j-th data line Dj to the first node N1. The third gray scale voltage V10 corresponds to a turn-off voltage at which the driving transistor DT is turned off, and thus the driving transistor DT is turned off during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the fourth gray scale voltage V11 that is a voltage obtained by subtracting the reference voltage variation ΔVREF from the third gray scale voltage V10 during the second period t2. Thus, the driving transistor DT is turned on during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes a voltage (V11−ΔVREF) obtained by subtracting the reference voltage variation ΔVREF from the fourth gray scale voltage V11 during the third period t3. Thus, the driving transistor DT is turned on during the third period t3.

When the voltage of the first node N1 is higher than the voltage (Vini+Vth2) by adding up the initialization voltage Vini and the threshold voltage Vth2 of the second transistor ST2, the second transistor ST2 is turned on. Thus, the voltage of the first node N1 is charged to the voltage (Vini+Vth2) obtained by adding up the initialization voltage Vini and the threshold voltage Vth2 of the second transistor ST2. That is, the voltage of the first node N1 is maintained by the second transistor ST2 to have a level higher than that of the voltage (Vini+Vth2) by adding up the initialization voltage Vini and the threshold voltage Vth2 of the second transistor ST2.

When the voltage of the first node N1 is lower than the voltage (V11+ΔVREF) obtained by subtracting the reference voltage variation ΔVREF from the fourth gray scale voltage V11, the range of the voltage applied to the gate electrode Vg of the driving transistor DT is excessively widened. In order to reduce or prevent such a problem, in this embodiment, the voltage of the first node N1 is maintained to a level higher than that of the voltage (Vini+Vth2) obtained by adding up the initialization voltage Vini and the threshold voltage Vth2 of the second transistor ST2, using the second transistor ST2. Thus, in this embodiment, it is possible to control the range of the voltage applied to the gate electrode Vg of the driving transistor DT so as not to be excessively widened.

As described above, in this embodiment, when the third gray scale voltage V10 is supplied to the j-th data line Dj, in synchronization with the k-th scan signal SCANk, the driving transistor DT is turned off during the first period t1, and turned on during the second and third periods t2 and t3. Thus, the organic light emitting diode OLED of the pixel P does not emit light during the first period t1, and emits light during the second and third periods t2 and t3. That is, the pixel P does not emit light during the first period t1, and emits light during the second and third periods t2 and t3.

Fourth, when the fourth gray scale voltage V11 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the fourth gray scale voltage V11 of the j-th data line Dj to the first node N1. Thus, the driving transistor DT is turned on during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is high by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitance C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes a voltage (V11−ΔVREF) obtained by subtracting the reference voltage variation ΔVREF from the fourth gray scale voltage V11 during the second period t2. Thus, the driving transistor DT is turned on during the second period t2.

The voltage of the first node N1 is higher than the voltage (Vini+Vth2) obtained by adding up the initialization voltage Vini and the threshold voltage Vth2 of the second transistor ST2, the second transistor ST2 is turned on. Thus, the voltage of the first node N1 is charged to the voltage (Vini+Vth2) obtained by adding up the initialization voltage Vini and the threshold voltage Vth2 of the second transistor ST2. That is, the voltage of the first node N1 is maintained by the second transistor ST2 to have a level higher than that of the voltage (Vini+Vth2) obtained by adding up the initialization voltage Vini and the threshold voltage Vth2 of the second transistor ST2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes a voltage (Vini+Vth2−ΔVREF) obtained by the reference voltage variation ΔVREF subtracted from the voltage (Vini+Vth2) obtained by adding up the initialization voltage Vini and the threshold voltage Vth2 of the second transistor ST2 during the third period t3. Thus, the driving transistor DT is turned on during the third period t3.

When the voltage of the first node N1 is higher than the voltage (Vini+Vth2) obtained by adding up the initialization voltage Vini and the threshold voltage Vth2 of the second transistor ST2, the second transistor ST2 is turned on. Thus, the voltage of the first node N1 is charged to the voltage (Vini+Vth2) obtained by adding up the initialization voltage Vini and the threshold voltage Vth2 of the second transistor ST2. That is, the voltage of the first node N1 is maintained by the second transistor ST2 to have a level higher than that of the voltage (Vini+Vth2) obtained by adding up the initialization voltage Vini and the threshold voltage Vth2 of the second transistor ST2.

As described above, in this embodiment, when the fourth gray scale voltage V11 is supplied to the j-th data line Dj, in synchronization with the k-th scan signal SCANk, the driving transistor DT is turned on during the first to third periods t1 to t3. Thus, the organic light emitting diode OLED of the pixel P emits light during the first to third periods t1 to t3. That is, the pixel P emits light during the first to third periods t1 to t3.

In this embodiment, the voltage of the first node N1 is maintained to a level higher than that of the voltage (Vini+Vth2) obtained by adding up the initialization voltage Vini and the threshold voltage Vth2 of the second transistor ST2. Thus, in this embodiment, it is possible to control the range of the voltage applied to the gate electrode Vg of the driving transistor DT not to be excessively widened.

As a result, the pixel P can express any one of (p+1) gray scale levels during the i-th subfield SFi according to which gray scale voltage the pixel P receives among the first to (p+1)-th gray scale levels. Thus, in this embodiment, when the one frame is divided into h (h is a positive integer of 2 or more) subfields for driving the organic light emitting display, the pixel P can be implemented to express $(p+1)^h$ gray scale levels.

Conventionally, each pixel expressed two gray scale levels in each subfield. However, in this embodiment, each pixel can express three or more gray scale levels in each subfield. Thus, in this embodiment, it is possible to reduce the number of subfields included in the one frame.

Figure 12:
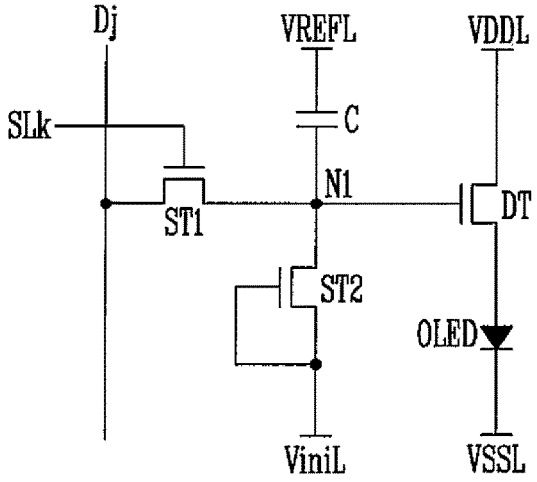
FIG. 12 is an equivalent circuit diagram of a pixel according to a fourth embodiment of the present invention.

FIG. 12 is an equivalent circuit diagram of a pixel according to a fourth embodiment of the present invention.

Referring to FIG. 12, the pixel P is coupled to the k-th scan line and the j-th data line. In addition, the pixel P is coupled to the high power voltage line VDDL, the low power voltage line VSSL and the reference voltage line VREFL.

The pixel P includes a driving transistor DT, an organic light emitting diode OLED, a plurality of transistors, a capacitor C, and the like. The plurality of transistors may include first and second transistors ST1 and ST2.

The driving transistor DT, the organic light emitting diode OLED, the first transistor ST1 and the capacitor C of the pixel P according to the fourth embodiment of the present invention is substantially identical to those of the pixel P according to the third embodiment of the present invention, except that the driving transistor DT and the first transistor ST1 are formed of N-type MOSFETs. Therefore, the detailed descriptions of the driving transistor DT, the organic light emitting diode OLED, the first transistor ST1 and the capacitor C according to the fourth embodiment of the present invention will be omitted.

The second transistor ST2 is coupled between the first node N1 and the initialization voltage line ViniL. A gate electrode and a first electrode of the second transistor ST2 are coupled to the initialization voltage line ViniL, and a second electrode of the second transistor ST2 is coupled to the first node N1. That is, the second transistor ST2 is diode-coupled.

The second transistor ST2 is formed of an N-type MOSFET, and thus is turned on when its gate-source voltage Vgs is higher than its threshold voltage Vth2 (Vgs>Vth). That is, the second transistor ST2 is turned on when the voltage difference between the initialization voltage that is a gate voltage and the voltage of the first node N1, which is a source voltage, is higher than the threshold voltage Vth2. As the second transistor ST2 is turned on, the first node N1 is coupled to the initialization voltage line ViniL. In this case, the voltage of the first node N1 is charged to the difference voltage (Vini−Vth2) between the initialization voltage Vini and the threshold voltage Vth2 of the second transistor ST2. As a result, the second transistor ST2 performs a function of maintaining the voltage of the first node N1 to be smaller than the difference voltage (Vini−Vth2) between the initialization voltage Vini and the threshold voltage Vth2 of the second transistor ST2.

Figure 13:
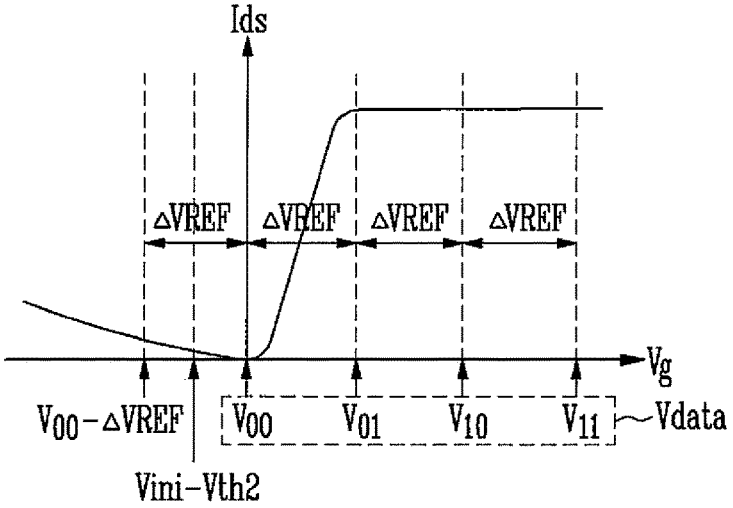
FIG. 13 is an example diagram illustrating drain-source current with respect to a gate voltage of a driving transistor in the pixel according to the fourth embodiment of the present invention.

FIG. 13 is an example diagram illustrating drain-source current with respect to a gate voltage of a driving transistor in the pixel according to the fourth embodiment of the present invention. In FIG. 13, the x-axis corresponds to gate voltages Vg of the driving transistor DT, and the y-axis corresponds to drain-source currents Ids. In the graph of FIG. 13, the case where the driving transistor DT is formed of an N-type MOSFET as shown in FIG. 12 has been primarily illustrated.

Figure 14:
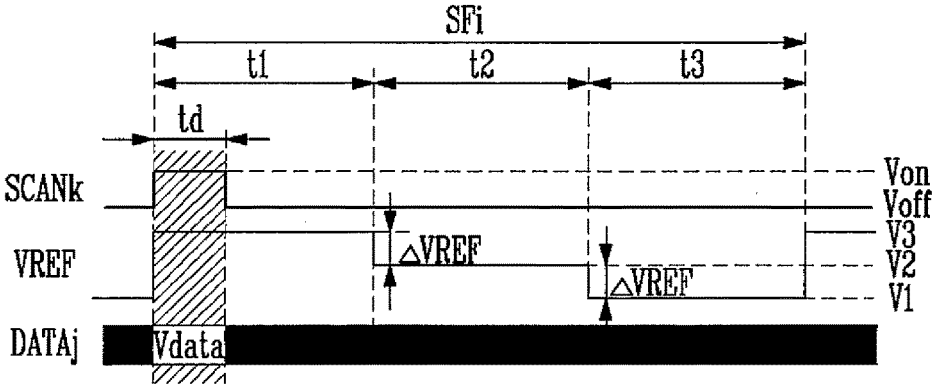
FIG. 14 is a waveform diagram illustrating an example of a scan signal, a reference voltage and a data voltage supplied to the pixel shown in FIG. 12.

One frame period is divided into a plurality of subfields, and each subfield is divided into p periods as shown in FIG. 14. In this case, the data voltage may be supplied as any one gray scale voltage among p+1 gray scale voltages. For convenience of illustration, the case where the one frame is divided into three subfields, and the data voltage is supplied as any one gray scale voltage among four gray scale voltages, i.e., first to fourth gray scale voltages V00, V01, V10 and V11 has been primarily described in FIG. 13. P periods of each subfield will be described in detail later with reference to FIG. 14.

Referring to FIG. 13, the driving transistor DT is formed of an N-type MOSFET. Thus, the driving transistor DT may be turned on when its gate-source voltage Vgs is higher than its threshold voltage, and be turned off when its gate-source voltage Vgs is lower than or equal to its threshold voltage. The first gray scale voltage V00 corresponds to a turn-off voltage at which the driving transistor DT is turned off. That is, the voltage difference (ELVDD−V00) between the high power voltage ELVDD and the first gray scale voltage V00 is lower than or equal to the threshold voltage of the driving transistor DT. The turn-off voltage refers to a voltage allowing the drain-source current Ids of the driving transistor DT, lower than a reference current (e.g., a predetermined current), to flow. The reference current (e.g., the predetermined current) may be current to an extent where (e.g., a current by which) the organic light emitting diode OLED hardly emits light (e.g., does not emit much light). The reference current (e.g., the predetermined current) may be previously determined through pre-experiments.

The second to fourth gray scale voltages V01, V10 and V11 correspond to turn-on voltages at which the driving transistor DT is turned on. That is, the voltage difference (ELVDD−V01) between the high power voltage ELVDD and the second gray scale voltage V01 is higher than the threshold voltage of the driving transistor DT, and the voltage difference (ELVDD−V10) between the high power voltage ELVDD and the third gray scale voltage V10 is higher than the threshold voltage of the driving transistor DT. The voltage difference (ELVDD−V11) between the high power voltage ELVDD and the fourth gray scale voltage V11 is higher than the threshold voltage of the driving transistor DT. The turn-on voltage refers to a voltage at which the channel in the driving transistor DT is almost opened, i.e., a voltage in a period where the drain-source current is saturated. The saturation period of the drain-source current is a period in which 90% or more of the drain-source current flows. In FIG. 10, the saturation period of the drain-source current corresponds to a period in which the threshold voltage of the driving transistor DT is higher than the second gray scale voltage V10.

The first to fourth gray scale voltages V00, V01, V10 and V11 may have a difference by a set voltage from each other. For example, when each subfield is divided into p periods, an r-th (r is a positive integer satisfying $1 \le r \le p$) gray scale voltage may be a voltage higher or lower by the set voltage than an (r+1)-th gray scale voltage. When each subfield is divided into the p periods, the set voltage corresponds to a voltage variation ΔVREF between a reference voltage in a q-th (q is a positive integer satisfying $1 \le q \le p$) period and a reference voltage in a (q−1)-th or (q+1)-th period that is a period adjacent to the q-th period. Hereinafter, for convenience of illustration, the voltage variation ΔVREF between the reference voltage in the q-th period and the reference voltage in the (q−1)-th or (q+1)-th period will be simply defined as a reference voltage variation.

FIG. 14 is a waveform diagram illustrating an example of a scan signal, a reference voltage and a data voltage, supplied to the pixel of FIG. 12. In FIG. 14, there are shown a k-th scan signal SCANk supplied to a k-th scan line SLk and a j-th data voltage DATAj supplied to a j-th data line Dj during an i-th subfield SFi. In addition, the reference voltage VREF supplied to the reference voltage line VREFL during the i-th subfield is shown in FIG. 14.

Referring to FIG. 14, the i-th subfield SFi is equally divided into p periods. Hereinafter, for convenience of illustration, the case where the i-th subfield SFi is equally divided into first to third periods t1, t2 and t3 as shown in FIG. 8 will be primarily described.

The k-th scan signal SCANk and the j-th data voltage DATAj, shown in FIG. 14, are substantially identical to those shown in FIG. 5, except that the gate-on voltage Von of the k-th scan signal SCANk is a voltage having a level higher than that of the gate-off voltage Voff. Therefore, the detailed descriptions of the k-th scan signal SCANk and the j-th data voltage DATAj, shown in FIG. 14, will be omitted.

The reference voltage VREF is lowered by the reference voltage variation ΔVREF every period of the first to third periods t1 to t3. Specifically, the reference voltage VREF is supplied as the third level voltage V3 during the first period t1, supplied as the second level voltage V2 during the second period, and supplied as the first level voltage V1 during the third period t3. The second level voltage V2 is a voltage higher by the reference voltage variation ΔVREF than the first level voltage V1, and the third level voltage V3 is a voltage higher by the reference voltage variation ΔVREF than the second level voltage V2. That is, the reference voltage VREF in the (q+1)-th period is lower by the reference voltage variation ΔVREF than that in the q-th period.

The reference voltage variation ΔVREF is set to a voltage higher than the minimum of the difference voltage between the turn-on voltage and the turn-off voltage of the driving transistor DT. When the reference voltage variation ΔVREF is lower than the minimum of the difference voltage between the turn-on voltage and the turn-off voltage of the driving transistor DT, the pixel P according to this embodiment emits light even though the pixel P is not to emit light.

Hereinafter, the operation of the pixel P during the first to third periods t1 to t3 when the data voltage Vdata is supplied as any one of the first to fourth gray scale voltages V00, V01, V10 and V11 will be described in detail with reference to FIGS. 12 to 14.

First, when the first gray scale voltage V00 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the first gray scale voltage V00 of the j-th data line Dj to the first node N1. The first gray scale voltage V00 corresponds to a turn-off voltage at which the driving transistor DT is turned off, and thus the driving transistor DT is turned off during the first period t1. In addition, the reference voltage VREF is supplied as the third level voltage V3 during the first period t1.

During the second period t2, the reference voltage VREF is supplied as the second level voltage V2. The second level voltage VREF supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes a voltage (V00−ΔVREF) obtained by subtracting the reference voltage variation ΔVREF from the first gray scale voltage V00 during the second period t2.

When the voltage of the first node N1 is lower than the difference voltage (Vini−Vth2) between the initialization voltage Vini and the threshold voltage Vth2 of the second transistor ST2. Thus, the voltage of the first node N1 is discharged to the voltage (Vini−Vth2) between the initialization voltage Vini and the threshold voltage Vth2 of the second transistor ST2. Accordingly, the driving transistor DT is turned off during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C1 coupled between the first node N1 and the reference voltage line VREFL. Thus, the voltage of the first node N1 is decreased (e.g., dropped) by the reference voltage variation ΔVREF during the third period t3.

When the voltage of the first node N1 is lower than the voltage (Vini−Vth2) between the initialization voltage Vini and the threshold voltage Vth2 of the second transistor ST2, the second transistor ST2 is turned on. Thus, the voltage of the first node N1 is discharged to the voltage (Vini−Vth2) between the initialization voltage Vini and the threshold voltage Vth2 of the second transistor ST2. Accordingly, the driving transistor DT is turned off during the third period t3.

When the gate voltage Vg of the driving transistor DT formed of an N-type transistor is lower than the first gray scale voltage V00 as shown in FIG. 13, the drain-source current Ids of the driving transistor DT is increased (e.g., raised) in proportion to the gate voltage Vg of the driving transistor DT even though the driving transistor DT is turned off. That is, the driving transistor DT leaks a current (e.g., a predetermined current), and therefore, the organic light emitting diode OLED may slightly emit light. However, in this embodiment, the voltage of the first node N1 is maintained by the second transistor ST2 to a level lower than that of the voltage (Vini−Vth2) between the initialization voltage Vini and the threshold voltage Vth2 of the second transistor ST2. Thus, it is possible to reduce (e.g., minimize) leakage of the drain-source current Ids of the driving transistor DT during the second and third periods t2 and t3.

As described above, in this embodiment, when the first gray scale voltage V00 is supplied to the j-th data line Dj, in synchronization with the k-th scan signal SCANk, the driving transistor DT is turned off during the first to third periods id to t3. Thus, the organic light emitting diode OLED of the pixel P does not emit light during the first to third periods t1 to t3, and accordingly, the pixel P does not emit light during the first to third periods t1 to t3.

Second, when the second gray scale voltage V01 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the second gray voltage V01 of the j-th data line Dj to the first node N1. Thus, the driving transistor DT is turned on during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the first gray scale voltage V00 that is a voltage obtained by subtracting the reference voltage variation ΔVREF from the second gray scale voltage V01 during the second period t2. Thus, the driving transistor DT is turned off during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes the voltage (V00−ΔVREF) obtained by subtracting the reference voltage variation ΔVREF from the first gray scale voltage V00 during the third period t3.

When the voltage of the first node N1 is lower than the voltage (Vini−Vth2) between the initialization voltage Vini and the threshold voltage Vth2 of the second transistor ST2, the second transistor ST2 is turned on. Thus, the voltage of the first node N1 is discharged to the voltage (Vini−Vth2) between the initialization voltage Vini and the threshold voltage Vth2 of the second transistor ST2. Accordingly, the driving transistor DT is turned off during the third period t3.

As described above, in this embodiment, when the second gray scale voltage V01 is supplied to the j-th data line Dj, in synchronization with the k-th scan signal SCANk, the driving transistor DT is turned on the first period t1, and turned off during the second and third periods t2 and t3. Thus, the organic light emitting diode OLED of the pixel P emits light during the first period t1, and does not emit light during the second and third periods t2 and t3. That is, the pixel P emits light during the first period t1, and does not emit light during the second and third periods t2 and t3.

In this embodiment, the voltage of the first node N1 is maintained by the second transistor ST2 to a level lower than that of the difference voltage (ELVDD−Vth2) between the high power voltage ELVDD and the threshold voltage Vth2 of the second transistor ST2. Thus, in this embodiment, it is possible to reduce (e.g., minimize) leakage of the drain-source current of the driving transistor DT during the third period t3.

Third, when the third gray scale voltage V10 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the third gray scale voltage V10 of the j-th data line Dj to the first node N1. Thus, the driving transistor DT is turned on during the first period t1. In addition, the reference voltage VREF is supplied as the third level voltage V3 during the first period t1.

During the second period, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the second gray scale voltage V01 obtained by subtracting the reference voltage variation ΔVREF from the third gray scale voltage V10 during the second period t2. Thus, the driving transistor DT is turned on during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes the first gray scale voltage V00 that is a voltage obtained by subtracting the reference voltage variation ΔVREF from the second gray scale voltage V01 during the third period t3. Thus, the driving transistor DT is turned off during the third period t3.

As described above, in this embodiment, when the third gray scale voltage V10 is supplied to the j-th data line Dj, in synchronization with the k-th scan signal SCANk, the driving transistor DT is turned on during the first and second periods t1 and t2, and turned off during the third period t3. Thus, the organic light emitting diode OLED of the pixel P emits light during the first and second periods t1 and t2, and does not emit light during the third period t3. That is, the pixel P emits light during the first and second periods V1 and t2, and does not emit light during the third period t3.

Fourth, when the fourth gray scale voltage V11 is supplied to the j-th data line Dj, in synchronization with the k-th scan signal SCANk, the operation of the pixel P during the first to third periods t1 to t3 will be described.

During the data voltage supply period td of the first period t1, the first transistor ST1 is turned on by the k-th scan signal SCANk to supply the fourth gray scale voltage V11 of the j-th data line Dj to the first node N1. Thus, the driving transistor DT is turned on during the first period t1. In addition, the reference voltage VREF is supplied as the third level voltage V3 during the first period t1.

During the second period t2, the reference voltage VREF is supplied as the second level voltage V2. The second level voltage V2 supplied during the second period t2 is lower by the reference voltage variation ΔVREF than the third level voltage V3 supplied during the first period t1. In this case, the reference voltage variation ΔVREF during the second period t2 is applied (e.g., reflected) to the first node N1 by the capacitance coupling by the capacitor C coupled between the first node N1 and the reference voltage line VREFL. Thus, the voltage of the first node N1 is decreased (e.g., dropped) by the reference voltage variation ΔVREF during the second period t2. That is, the voltage of the first node N1 becomes the third gray scale voltage V10 that is a voltage obtained by subtracting the reference voltage variation ΔVREF from the fourth gray scale voltage V11 during the second period t2. Thus, the driving transistor DT is turned on during the second period t2.

During the third period t3, the reference voltage VREF is supplied as the first level voltage V1. The first level voltage V1 supplied during the third period t3 is lower by the reference voltage variation ΔVREF than the second level voltage V2 supplied during the second period t2. In this case, the reference voltage variation ΔVREF during the third period t3 is applied (e.g., reflected) to the first node N1 by the capacitance coupling of the capacitor C coupled between the first node N1 and the reference voltage line VREFL. Thus, the voltage of the first node N1 is decreased (e.g., dropped) by the reference voltage variation ΔVREF during the third period t3. That is, the voltage of the first node N1 becomes the second gray scale voltage V01 that is a voltage obtained by subtracting the reference voltage variation ΔVREF from the third gray scale voltage V10 during the third period t3. Thus, the driving transistor DT is turned on during the third period t3.

As described above, in embodiments of the present invention, when the fourth gray scale voltage V11 is supplied to the j-th data line Dj, in synchronization with the k-th scan signal SCANk, the driving transistor DT is turned on during the first to third periods t1 to t3. Thus, the organic light emitting diode OLED of the pixel P emits light during the first to third periods t1 to t3. That is, the pixel P emits light during the first to third periods t1 to t3.

As a result, the pixel P can express any one of (p+1) gray scale levels during the i-th subfield SFi according to which gray scale voltage the pixel P receives among the first to (p+1)-th gray scale levels. Thus, in this embodiment, when the one frame is divided into h (h is a positive integer of 2 or more) subfields for driving the organic light emitting display, the pixel P can be implemented to express $(p+1)^h$ gray scale levels.

Conventionally, each pixel expressed two gray scale levels in each subfield. However, in this embodiment, each pixel can express three or more gray scale levels in each subfield. Thus, in this embodiment, it is possible to reduce the number of subfields included in the one frame.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display comprising: a display panel comprising pixels at crossing regions of data lines and scan lines; a scan driver configured to divide one frame into a plurality of sub-fields, to divide each of the subfields into p (p is a positive integer of 2 or more) periods, and to supply scan signals to the scan lines; and a data driver configured to supply data voltages to the data lines concurrently with supply of respective scan signals, wherein a gray scale voltage among (p+1) gray scale voltages is supplied as at least one of the data voltages, to have different voltage levels during each period of a corresponding subfield.

2. The organic light emitting display of claim 1, wherein each of the pixels comprises:

a driving transistor comprising a gate electrode and configured to be turned on or turned off according to a voltage of the gate electrode;

a first transistor configured to supply a data voltage of a data line of the data lines to the gate electrode of the driving transistor in response to a scan signal of a scan line of the scan lines; and an organic light emitting diode configured to emit light according to a drain-source current of the driving transistor.

3. The organic light emitting display of claim 2, wherein each of the pixels further comprises a capacitor coupled between the gate electrode of the driving transistor and a reference voltage line to which a reference voltage is supplied.

4. The organic light emitting display of claim 3, wherein the reference voltage in a q-th (q is a positive integer satisfying $1 \leq q \leq p$) period is a voltage higher or lower by a set voltage than a reference voltage in a (q+1)-th period.

5. The organic light emitting display of claim 4, wherein an r-th (r is a positive integer satisfying $1 \leq r \leq p$) data voltage is a voltage higher or lower by the set voltage than a (r+1)th data voltage.

6. The organic light emitting display of claim 5, wherein each of the pixels further comprises a second transistor coupled between the gate electrode of the driving transistor and a power voltage line for supplying a power voltage.

7. The organic light emitting display of claim 6, wherein the power voltage is a high power voltage and the power voltage line is coupled to a first electrode of the driving transistor.

8. The organic light emitting display of claim 6, wherein the power voltage is an initialization voltage.

9. A method for driving an organic light emitting display comprising a display panel comprising pixels arranged in a matrix at crossing regions of data lines and scan lines, the method comprising: dividing one frame into a plurality of sub-fields, dividing each of the subfields into p (p is a positive integer of 2 or more) periods, and supplying scan signals to the scan lines; and supplying data voltages to the data lines concurrently with the respective scan signals of the plurality of scan signals, wherein, in the supplying of the data voltages to the data lines, a gray scale voltage among (p+1) gray scale voltages is supplied as at least one of the data voltages, to have different voltage levels during each period of a corresponding subfield.

10. The organic light emitting display of claim 1, wherein a period length of each of the p periods are equal to each other.

11. An organic light emitting display comprising: a display panel comprising pixels at crossing regions of data lines and scan lines; a scan driver configured to divide one frame into a plurality of sub-fields, to divide each of the subfields into p (p is a positive integer of 2 or more) periods, and to supply scan signals to the scan lines; and a data driver configured to supply data voltages to the data lines concurrently with supply of respective scan signals, and to supply (p+1) grayscale voltages as the data voltages, to have different voltage levels during each period of a corresponding subfield.

* * * * *